United States Patent [19]

Ming-Hwa

[11] Patent Number: 5,024,606

[45] Date of Patent: Jun. 18, 1991

[54] COAXIAL CABLE CONNECTOR

[76] Inventor: Yeh Ming-Hwa, No. 2, Lane 8, Hsin An Rd., Shih Lin District, Taipei, Taiwan

[21] Appl. No.: 442,129

[22] Filed: Nov. 28, 1989

[51] Int. Cl.[5] ..... H01R 17/18

[52] U.S. Cl. ..... 439/578

[58] Field of Search ..... 439/578–585

[56] References Cited

U.S. PATENT DOCUMENTS 3,439,294 4/1969 Flanagan et al. ..... 439/585

4,834,675 5/1989 Samchisen ..... 439/578

*Primary Examiner*—Joseph H. McGlynn

*Attorney, Agent, or Firm*—Asian Pacific Int'l Patent and Trademark Office

[57] ABSTRACT

A coaxial cable connector including a screw threaded tube, a male clamping tube and a female clamping tube. The male clamping tube has a central hole, a rear projection pipe and a clamping portion, whereby an insulating portion of a concentric coaxial cable fits into the projection pipe with an outer cover and separate grounding wire sheath of the concentric coaxial cable fitted between the projecting pipe and clamping portion. The inner wall of the female clamping tube is formed with rearwardly tapering inclined portion whereby when the female clamping tube is fitted to the male clamp portion, the tapering portion presses the clamping section of the male clamping tube making the saw tooth portion of the inner wall of the clamping portion securely bite into the concentric coaxial cable. An annular projecting shoulder formed on an outer wall of the clamping portion of the male clamping tube engages an annular groove formed on inner wall of the female clamping tube to join the male and female clamping tubes. The joined clamping tubes are fitted into the screw threaded tube having threads on an inner wall formed to thread on a coaxial cable socket with an axial connecting wire of the coaxial cable passing through the male clamping tube into an output hole of the coaxial cable socket.

5 Claims, 4 Drawing Sheets

COAXIAL CABLE CONNECTOR

BACKGROUND OF THE INVENTION

The present invention relates to a concentric coawial cable terminal connector, and more particularly to three piece a coaxial clamping cable connector.

In the conventional radio frequency (RF) distribution and interconnect systems such as cable TV (CATV), satellite TV (SMATV), master antenna TV (MATV) video, and date, concentric coaxial cable is needed to properly shield and transfer the signals. As a result, the quality of a coaxial cable connection and its precise application directly affects the quality of the signal passing through it, as well as the maintenance of the entire signal within the cable. Of course, the quality of the coaxial cable connection can be no better than the connector or terminal used to make it.

Outdoor terminals are particularly important because they are exposed to moisture and chemicals and are easily damaged resulting in signal loss, distortion, radiation and unwanted reflections. Moreover, the outdoor coaxial cables are frequently separated from the terminal by common excessive foreign forces as well a by normal forces due to incorrect of poor installations. Poor installations can result from the common misuse of the proper size terminal or tool, or the use of less than the specified installation force.

New Federal Communication Commission (FCC) rules, effective in 1990, require RF, and specifically television signal distribution and interconnect systems, to limit signal leakage radiation to minimum levels. The most common cause of this radiation has been found to result for loose or poorly installed cable tarminals. The above deficiencies of presently used coaxial cable terminal results from a design which requires a precision fit between terminal and cable, the proper size specialty installation tool, and a precise minimum clamping force. In addition, the reliability of the commonly used terminal has been comprised due to the use of new cable jacket materials such as teflon and fire retardant polyvinylchloride (PVC). These materials have differing holding strengths and interface surface requirements which cannot easily be met by presently used terminal designs.

The most commonly used terminal design consists of a clamping tube which is fitted to a freely rotatable screw tube. Attachment to the end of a coaxial cable is accomplished by means of clamping action on the cable jacket and shield held between the inner tube and the deformed, clamped outer tube. Some terminals have additional outer clamping rings around the outer clamping tube to provide additional strength. However, since to clamping force exerted on the terminal is of varying strength resulting from each individual installers ability, strength and attitude, the overall reliability is uncontrollable and has resulted in excessive cost, repair time and lack of system integrity.

Furthermore, present terminal designs require the use of a special heavy tool requiring the use of two hands, sufficient leverage, and adequate space for proper installation. They are inconvenient and have not been effective.

Therefore, there is a need for a coaxial cable connector that can achieve a good strong connection, is easy to install with common tools and is adaptable to a variety of cable size and jackets.

SUMMARY OF THE INVENTION

It is therefore a primary object of the present invention to provide a coaxial cable connector, which can fit all size cables and maintain a specified pull strength on all types of jacket materials. A coaxial cable meeting these requirements has concentric cable tubes comprised of male and female clamping tubes. The male clamping tube is formed with a control hole, rear projecting pipe and a rear clamping portion. The insulating portion of a coaxial cable can be inserted into the projecting pipe, with the axial wire passing through the control hole and protruding beyond the male clamping tube. The female clamping tube is fitted around the clamp portion, and by means of a threaded tubular housing of the female clamping tube, having a gradually reduced diameter and the clamping portion is securely clamped to the cable via saw tooth portion formed on its inner wall. Moreover, annual projections are formed on the periphery of the clamping portion, suitably inserted into an annular groove formed on an inner wall of the female clamping tube to join the female and male clamping tubes. The screw threaded tube is freely rotatable and encloses the joined clamping tubes and can be conveniently screwed on a concentric cable socket without twisting the axial wire.

To install the terminal, the screw threaded tube, female clamping tube and male clamping tube are fitted around the coaxial cable sequence. The female clamping tube is loosely fitted axially to the clamping portion, with the screw threaded tube or housing axially housing the two clamping tubes. As this time, the screw threaded tube is threaded onto a cable socket with a wrench to force the female clamping tube forward and engage the male clamping tube.

According to the above arrangement, the present invention can connect concentric coaxial cables of same specification but with different shielding rate to eliminate the deficiency existing in prior art devices of one terminate can only connect with concentric cables having the same shielding rate.

The above and other features of this invention will be fully understood from the following detailed description and the accompanying drawings, in which:

DETAILED DESCRIPTION OF THE PREFERRED EMBODIMENT

Figure 1:
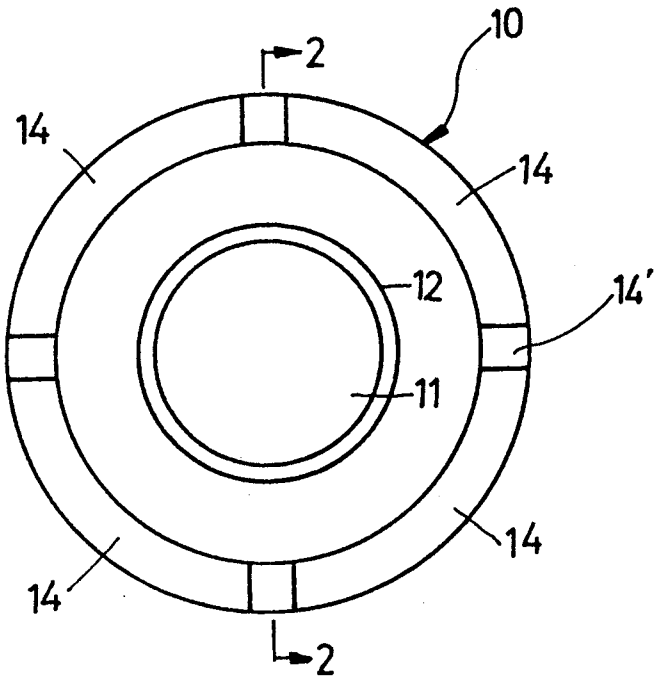
FIG. 1 is a front view of the male clamping tube according to the present invention.
Figure 2:
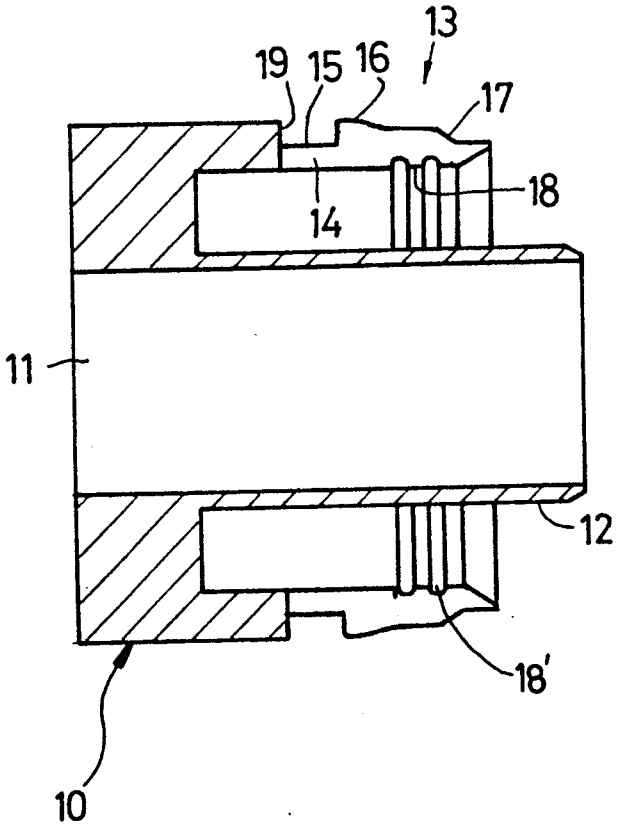
FIG. 2 is a sectional view taken on line 2—2 in FIG. 1.
Figure 3:
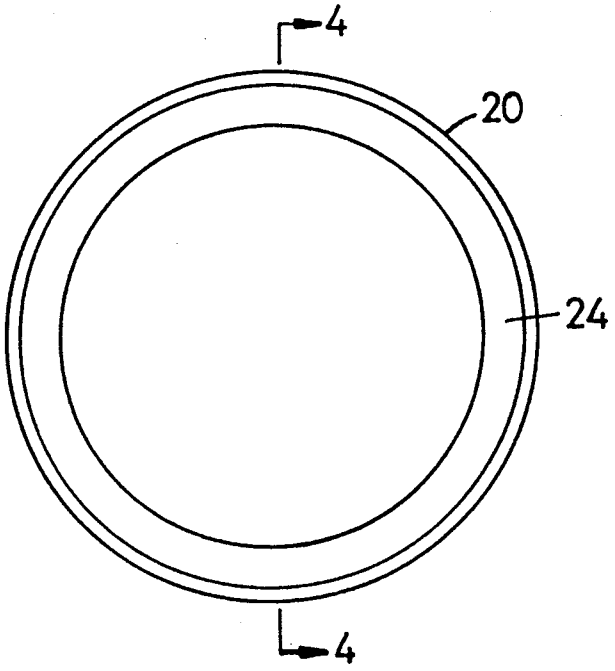
FIG. 3 is a front view of the female clamping tube according to the present invention.
Figure 4:
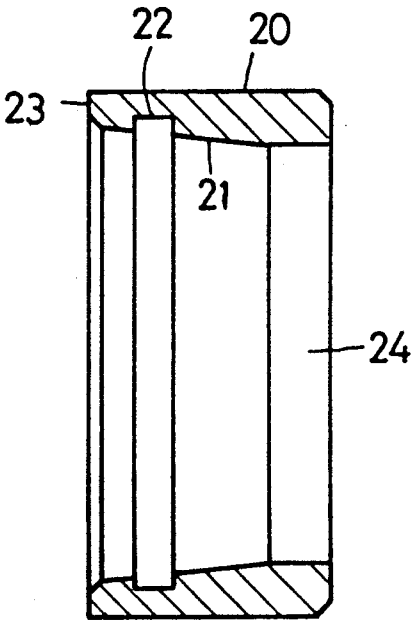
FIG. 4 is a sectional view taken on line 4—4 in FIG. 3.
Figure 5:
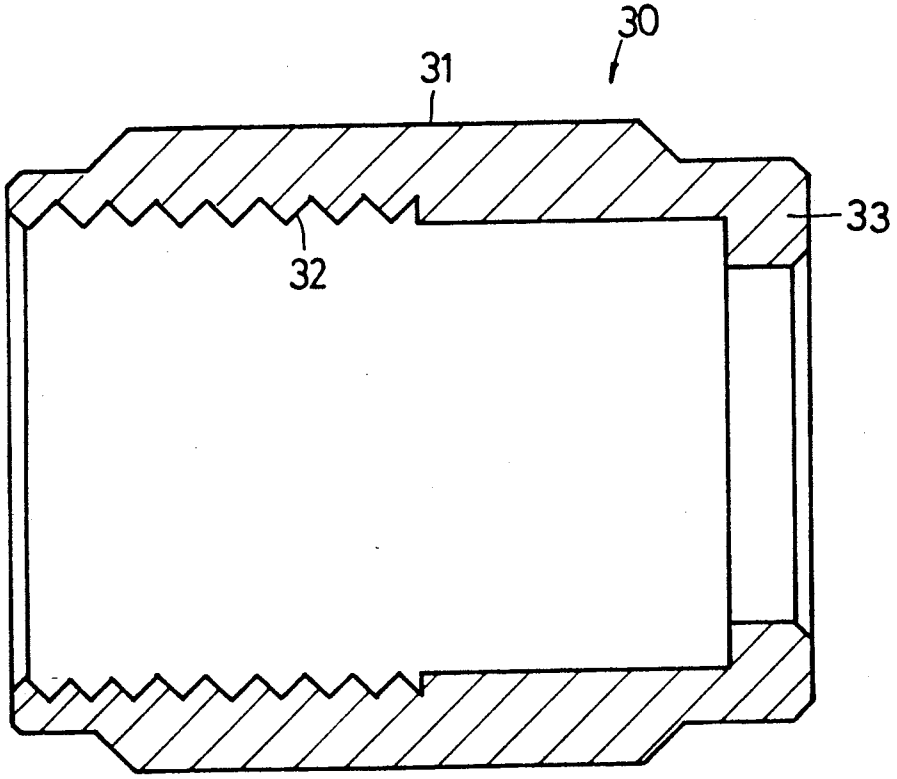
FIG. 5 is a sectional side view of a threaded tube according to the present invention.
Figure 6:
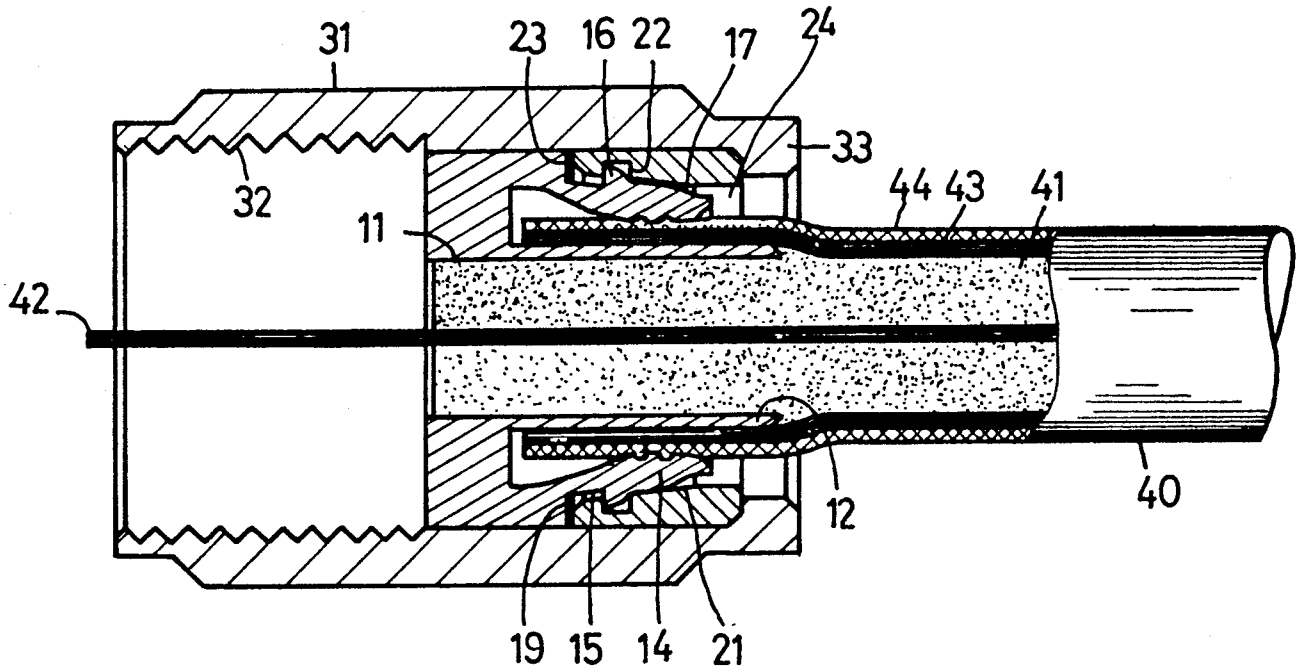
FIG. 6 is a sectional side view illustration assembly and installation of the invention.

Referring to FIG. 1 through FIG. 6 the coaxial cable connector of the present invention includes male clamping tube 10, female clamping tube 20 and screw threaded tube or tubular 30. Male clamping tube 10 has central hole 11 with the rear end formed with projecting pipe 12 having a thin wall. The inner diameter of central hole 11 is slightly larger that an outer diameter of the insulating core portion 41 of coaxial cable 40, permitting axial wire 42 to pass trough the central hole 11 and protrude beyond the fron end of male clamping tube 10. Projecting pipe 12 is inserted between the insulating core 41 and separate ground wire sheath 43. Clamping portion 13 is formed on the rear end of male clamping tube 10. Clamping portion 13 has several circularly arranged clamping plates or sections 14 extending rearward formed by slots 14.

A forward end of clamping portion 13 in front of clamping plates 14 is formed with an annular grove 15, permitting clamping plate 14 to be deformed and displaced inward. Rearwardly inclined projecting shoulders 16 adjacent annular groove 15 are formed on clamping sections 14. The rear ends of the clamping sections 14 to smoothly engage female clamping tube 20. In addition, the inner walls of clamping sections 14 have several annular channels 18' forming saw tooth portion 18 capable of biting into outer cover 44 of coaxial cable 40.

Female clamping tube 20 has an outer diameter equal to that of male clamping tube 10, so that clamping tubes 10, 20 can mate and be engaged to form a single tubular assembly. The inner wall of female clamping tube 20 has a rearwardly inclined or tapered portion 21 terminating at annular groove 22. The inner diameter of female clamping tube 20 to be inserted until projecting shoulder 15 engage annular groove 22 with forward end surface 23 of female clamping tube 20 in abutment with the forward end wall 19 of annular groove 15 on clamping portion 13. An inner flange or recess is formed at the rear end of female clamping tube 20. Inner flange or recess 24 has an inner diameter substantially equal to the outer diameter of clamping portion 13, so that the space between female clamping tube 20 and cable 40 is protected by inner flange 24 to prevent moisture from entering and improve the appearance.

Screw threaded tube 30 (FIG. 5) has an outer wall formed of a hexagonal body 31 providing wrench flats for the convenience of operation with a standard wrench. Threads 32 are formed on the interior surface of the forward end of threaded tube 30. The rear end of screw threaded tube 30 is disposed with inwardly extending flange 33 having an inner diameter smaller than the outer diameters of the male and female clamping tubes 10, 20, respectively, but larger than outer diameter of concentric coaxial cable 40, retaining the joined clamping tubes 20, 30 inside screw threaded tube or housing 30.

To assemble the connector a selected length of separate grounding wires or conductive sheath 43 and outer cover 44 of concentric coaxial cable 40 are stripped away to expose insulating core portion 41. A small section of insulating core portion 41 is then stripped to expose a selected length of axial connecting wire 42. Screw threaded tubular housing 30, female clamping tube 20 and male clamping tube 20 are sequentially fitted over the end of the concentric coaxial cabe 40 with projecting pipe 23 inserted over insulating core portion 41 and under grounding conductive sheath 43. Axial wire 42 protrudes beyond the front end of male clamping tube 10. Screw threaded tube 30 coaxially houses clamping tubes 10, 20 2which surround the coaxial cable 40. Screw threaded tube 30 is screwed on a threaded sockect (not shown) and tightened with a wrench. Flange 33 abuts the end of female clamping tube 20, while the end of male clamping tube 10 abuts the end of the threaded socket forcing the male and female clamping tubes 10, 20 axially together, causing tapered portion 21 of female clamping tube 20 to press clamping sections 14 of clamp portion 13 inward. This causes saw tooth portion 18 of the clamping section 14 to bite into outer insulating cover 44 of the coaxial cable 40. Screw threaded tube 30 is tightened until the front surface 23 of female clamping tube 20 abuts against front end 19 of annular groove is with projection is engaging annular groove 22.

According to the above arrangement, coaxial cable 40 is securely fastened to the cable terminal by a strong clamping force and cannot be easily detached therefrom. Projection 16 engaging annular groove 22 prevents male clamping tube 10 from separating from female clamping tube 20. Futhermore, axial connecting wire 42 can be easily inserted into an output signal socket to connect to the coaxial cable socket.

The present invention is characterized by the following features:

1. Easy installation without using special tools.
2. Suitable for coaxial cable with various shielding braid size to improve the conventional coaxial cable shielding where previously cable with different shielding where previously cables with different shielding rates must employ different terminals.
3. Ensures 75 Ohm impedance matching, particularly for large cable television systems so that poor picture quality from some terminals caused by connectors having different impedance matching may be avoided.
4. After the cable is tightly clamped, the clamped portion is uniquely independent of the nut and is not separated due to losseness of the nut.
5. Possesses accurate clamping forces and is not affected and separated by temperature changes causing thermal expansion and contraction.
6. Reduces RF leakage and achieves reliable performance.

This invention is not to be limited by the embodiment shown in the drawings and described in the description which is given by way of example and not of limitation, but only in accordance with the scope of the appended claims.

I claim:

1. A coaxial cable connector, comprising:

a male clamping tube having a central hole and a rear projecting pipe, said male clamping tube having an inner diameter slightly larger than the outer diameter of an insulating portion of a concentric cable, and a rear clamping portion having several circularly arranged clamp sections extending rearward, the front ends of said clamp plates being formed with an annular groove so that said clamping section can be deformed and inwardly deflected; an annular projecting shoulder inwardly and rearwardly inclined, formed on said clamping sections, the rear ends of said clamp sections having an inwardly and rearwardly inclined face, the inner walls of said clamp plates being formed with a saw tooth portion;

a female clamping tube having a rearwardly tapered interior surface and an annular groove; and a screw threaded tube housing having threads formed on an inner wall of the front end, said screw threaded tube housing receiving and enclosing said male and female clamping tubes, an inward extending flange being formed at rear end of said screw threaded tube, said flange having an inner diameter smaller than outer diameters of said male and female clamping tube but larger than outer diameter of a coaxial cable, whereby when assembled, said screw thread tube and female clamping tube and male clamping tube are sequentially fitted over said coaxial cable with said insulating portion inserted into said projecting pipe and an axial wire of said coaxial cable protruding beyond front end of said male clamping tube, said female clamping tube engaging said clamping portion of said male clamping tube to press said clamping section until said annular projection engages said annular groove of said female clamping tube locking said male and female clamping tubes on said coaxial cable.

2. A connector for coaxial cables comprising:

a male clamping tube having a pipe portion slotted to form a plurality of clamping sections, said pipe portion having a diameter for fitting over the insulating core and under the grounding earth of a coaxial cable;

a female clamping tube having mating with said male clamping tube, said female clamping tube having an inner tappered surface for pressing said clamping sections inward against said coaxial cable;

looking means for looking said male clamping tube and said female clamping to be together with said clamping sections gripping said coaxial cable;

a tubular housing having threads in on end and a retaining flange at the opposite end, said tubular housing constructed to fit around said mated male and female clamping tubes with said retaining flange abutting a rearward end of said female clamping tube;

whereby when said tubular housing is threaded onto a threaded coaxial cable socket, said male and female clamping tubes an axial forced together clamping said clamping sections on said coaxial cable until said locking means is engaged.

3. The connector according to claim 2 in which; said male clamping tube clamping section is slotted to form four equal clamping sections.

4. The connector according to claim 3 in which said tubular housing has wrench flats formed on its external surface for use with a standard wrench.

5. The connector according to claim 2 in which said locking means comprises; a projecting shoulder on said clamping section of said male clamping tube engaging an annular groove in the interior of said female clamping tube.

* * * * *